US005148663A

United States Patent [19]

Aalderink

[11] Patent Number: 5,148,663

[45] Date of Patent: Sep. 22, 1992

[54] ARRANGEMENT FOR GENERATION OF FANCY TWISTS ARRANGED AND/OR FORMED AT RANDOM ON A YARN

[75] Inventor: Friedrich Aalderink, Greenville, S.C.

[73] Assignee: Eno Electronic GmbH, Fed. Rep. of Germany

[21] Appl. No.: 463,834

[22] Filed: Jan. 9, 1990

Related U.S. Application Data

[63] Continuation of Ser. No. 207,755, Jun. 16, 1988, abandoned.

[30] Foreign Application Priority Data

Jun. 16, 1987 [DE] Fed. Rep. of Germany ..... 37201069

[51] Int. Cl.[5] ..... D01H 13/02

[52] U.S. Cl. ..... 57/91; 28/252

[58] Field of Search ..... 57/91, 90, 908; 226/108, 181, 182; 28/251, 252, 253, 269

[56] References Cited

U.S. PATENT DOCUMENTS

| | | | |
|---|---|---|---|
| 3,325,071 | 6/1967 | Schmitz | 226/108 X |
| 3,387,758 | 6/1968 | Delany et al. | 226/108 |
| 3,805,344 | 4/1974 | Bartnicki et al. | 57/91 X |
| 3,835,511 | 9/1974 | Schrader et al. | 57/91 X |
| 4,014,489 | 3/1977 | Bialek | 28/252 X |
| 4,170,865 | 10/1979 | Pike | 57/91 X |
| 4,368,612 | 1/1983 | Eschenbach | 57/91 X |
| 4,567,720 | 2/1986 | Price | 57/91 X |

FOREIGN PATENT DOCUMENTS

| | | | |
|---|---|---|---|
| 1042582 | 9/1966 | United Kingdom | 28/243 |

*Primary Examiner*—Joseph J. Hail, III

*Attorney, Agent, or Firm*—Lee, Mann, Smith, McWilliams, Sweeney & Ohlson

[57] ABSTRACT

Fancy twists arranged and/or formed at random are provided on a yarn. The threads are delivered by a feed device at different feed speeds. The feed device has a first roller and a second roller, which rotate at different peripheral speeds. A yarn thread is arranged to be pressed optionally against one or the other roller by idler rollers. The idler rollers are directly actuated by a solenoid each. The solenoids are energized in push-pull mode by a random generator. The second roller forms part of a stepped roller assembly having rollers of different diameters, each of these rollers cooperating with a separate idler roller controlled by a solenoid.

5 Claims, 4 Drawing Sheets

ARRANGEMENT FOR GENERATION OF FANCY TWISTS ARRANGED AND/OR FORMED AT RANDOM ON A YARN

This application is a continuation, of application Ser. No. 07/207,755, filed Jun. 16, 1988.

TECHNICAL FIELD

The invention relates to an arrangement for the generation of fancy twists arranged and/or formed at random on a yarn, comprising a) a fancy twist device through which at least one yarn thread is led, and b) a feed device adapted to feed a yarn thread at different speeds through the fancy twist device with a first roller, which rotates at a first speed a second roller, which rotates at a second speed which differs from that of the first roller, and idler rollers which are electromagnetically controlled and which are arranged to press the yarn thread optionally against the first or the second roller, and c) a control device arranged to control the feed device is in an irregular sequence The problem is as follows: Yarns are to be produced having certain irregularities thereon, for example naps or knots. A certain desired optical effect in the finished woven cloth or knitted fabrics is achieved thereby. These irregularities are achieved by guiding a yarn thread or a plurality of yarn threads to a fancy twist device such as an air texturing device in temporal sequences of different speeds. It is essential that the fancy twists occur in random sequences and that no periodicity occurs. In this latter case, undesirable patterns ("figuring up") would appear in the fabric during the weaving process.

BACKGROUND ART

U.S. Pat. No. 3,805,344 discloses a texturing device wherein a yarn thread to be texturized is fed from a supply spool through a feed device into a fluid jet of a texturing device. The yarn thread guided through the fluid jet is then passed over a tension fork and is wound on a take up spool.

The feed device contains two rollers which are driven at different peripheral speeds, namely a first roller which rotates at a relatively slow speed and a second roller the peripheral speed of which is essentially higher. The yarn thread is guided past both rollers. Idler rollers serve to press the yarn thread optionally either against the first roller of the feed device or to the second roller. In the former case, the yarn thread is fed to the texturing device at relatively low speed. In the latter case, the yarn thread is fed at a substantially increased speed. In order to ensure that the yarn thread can be pressed against the second roller by the respective idler roller only after the idler roller has been lifted from the first roller, the two idler rollers are mounted on a pivotable two-armed lever. This lever is held in its normal position by a spring. In this normal position the yarn thread is pressed against the first roller by one idler roller and the other idler roller is lifted off. The lever is rotated into another position by a solenoid against the action of a spring. In this other position said one idler roller is lifted off from the first roller of the feed device and, instead, the other idler roller presses the yarn thread into contact with the second roller.

In this prior art device, the push-pull control of the idler rollers is achieved mechanically by arranging the two idler rollers on a common pivotable lever.

Furthermore it is known to couple one roller of a feed device through magnet clutches optionally with a slow and a fast drive device (Company brochure "Flammen—und Farb—Effekteinrichtung Modell Fatex zur Luft—Texturier—Maschine Modell AT/AT—GD" of Eltex Textilveredelungs—Maschinen GmbH, Reutlingen (West Germany).

In the prior art devices, the solenoids or magnet clutches, respectively, are controlled by control devices which work with punched cards. After one passage of such a punched card (repeating) the temporal sequence of the control commands are repeated. This can result in the formation of patterns (figuring up) in the woven cloth described in the beginning. Though program disturbances are provided to avoid such figuring up. However this is not always successful, whereby second-class end products are obtained.

The lengths of the fancy twists produced on the yarn are to lie within a certain range and are not to exceed a certain upper limit. On the other hand the feed speed is to be as high as possible, in order to increase the output of the machine. In the prior art, a limit is reached due to the inertia of the moved masses, for example of the pivotable lever of U.S. Pat. No. 3,805,344 mentioned above or of the magnet clutches. With a predetermined maximum length of the fancy twist produced, a maximum feed speed determined by the reaction time of the change-over.

Eventually the possibilities of variation provided by the prior art devices are rather limited.

DISCLOSURE OF THE INVENTION

It is an object of the invention, in a device of the type mentioned in the beginning for producing fancy twists arranged at random on a yarn, to enable increase of the feed speed with a given upper limit of the length of the fancy twists produced, by reducing the reaction time when changing the feed speeds of the feed device.

A further object of the invention is to avoid figuring up in a device of the type mentioned in the beginning.

A still further object of the invention is to increase the number of the possible variations in a device mentioned in the beginning.

According to the invention these objects are achieved in that d) each idler roller is moveable by a separate solenoid to press the yarn thread against the first roller and to press the yarn thread against the second roller and e) the solenoids are controllable by the control device in push-pull mode Preferably the control device is a random generator.

Reduction of the moveable masses can be achieved in particular by mounting each of the idler rollers directly on the armature of the respective solenoid.

The number of possible variations can be increased in that a) the second roller is part of a stepped roller means which consists of a plurality of rollers with different diameters.

b) a plurality of yarn threads are guided over one roller each of the stepped roller means and c) each roller of the stepped roller means is associated with an idler roller which is moveable in engagement position by a separate solenoid.

The random generator may then be programmed to control the following functions according to random distributions within given limits:

a) the selection of the idler roller to be pressed against the associated roller of the stepped roller means while simultaneously lifting the idler roller by which the respective yarn thread was pressed against the first roller, b) the time interval between the pressing of the different idler rollers against the associated roller of the stepped roller means and c) the time intervals, during which the different idler rollers were pressed against the associated roller of the stepped roller means.

It has been found that the control of the idler rollers in accordance with the invention through individual solenoids permits considerable reduction of the moveable masses. As only small inertial forces have to be overcome, smaller solenoids can be used, which, in turn, respond faster. Therefore the response time of the feed device to a command for changing the feed speeds can be reduced considerably as compared to the prior art. Thereby higher feed speeds become possible and thus, in turn, an increased output of the machine. Synchronization of the engagement and lifting off of the two idler rollers relative to the associated rollers of the feed device is not effected mechanically by means of a pivotable lever as in the U.S. Pat. No. 3,805,344 but electrically by appropriate energizing circuits for the associated solenoids, which operate vitually without inertia. It has been found that unobjectionable change over is possible in this way.

The electronic random generator permits representation of a virtually infinite repeat. Therefore there are no periodic repetitions of a pattern of the fancy twists on the yarn, whereby no figuring up occurs.

By using the stepped roller means, additional variables are provided, whereby the number of available variations is considerably increased as compared to the prior art.

An embodiment of the invention will now be described with reference to the accompanying drawing.

PREFERRED EMBODIMENT OF THE INVENTION

Figure 1:
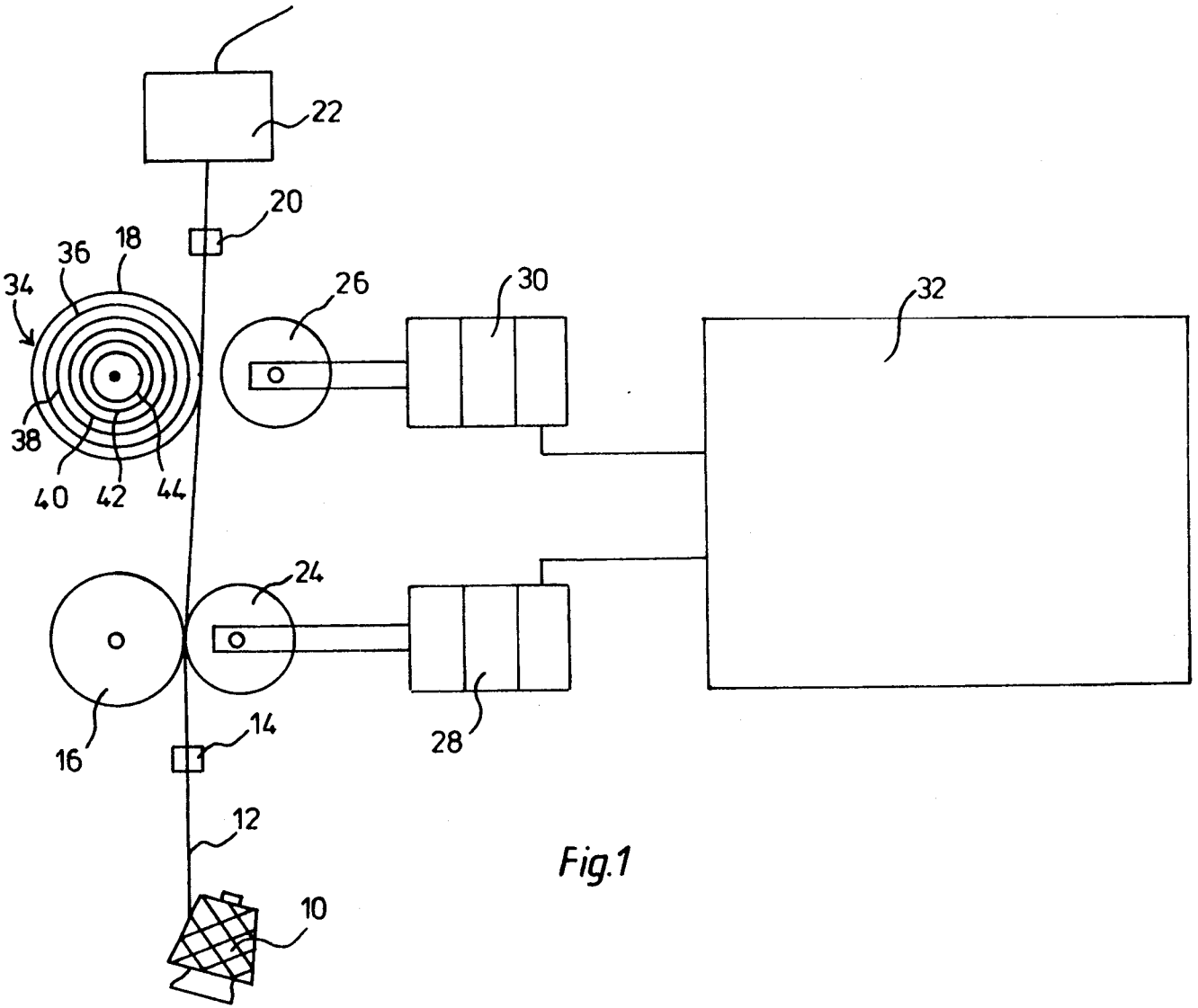
FIG. 1 is a schematic illustration of a device for generating fancy twists arranged and/or formed at random on a yarn.

Referring to FIG. 1, numeral 10 designates a supply spool for a yarn thread 12 to be processed. The yarn thread 12 is guided through a yarn guide 14 and past a first roller (feed roller) 16 and a second roller (fancy twist roller) 18. Then the yarn thread 12 passes through a further, upper yarn guide 20 to a fancy twist device 22. The first roller 16 is driven at a relatively low peripheral speed. The second roller has a substantially higher perioheral speed.

The yarn thread can be pressed against the first roller 16 by a first idler roller 24. The first roller 16 is provided with a rubber surface, whereby the yarn thread, in this case, will be delivered with the peripheral speed of the first roller. By means of a second idler roller 26 the yarn thread 12 can be pressed against the second roller 18, whereby it will be delivered at the higher peripheral speed of the second roller 18. The first idler roller 24 is arranged to be moved by a solenoid 28 into its idler position illustrated in FIG. 1. The second idler roller 26 is movable by a solenoid 30 into a idler position in which it presses the yarn thread against the second roller 18. The two solenoids are arranged to be energized in push-pull mode whereby only one idler roller at a time can be in its idler position. The solenoid 28, 30 can move the associated idler roller 24, 26 into its idler position or may remove it from this position. In order to achieve high cycle frequencies, the solenoid may also move the idler roller into its idler position and remove it from the idler position by means of two coils acting in opposition.

The solenoids are controlled by an electronic random—noise generator 32.

In the illustrated preferred embodiment, the second roller 18 is part of a stepped roller means 34. The stepped roller means 34 consists of a plurality of rollers having different diameters, namely besides the roller 18 of the rollers 36,38,40,42 and 44. In a manner to be described hereinbelow, the rollers 18 and 36, 38, 40, 42 and 44 are arranged co-axially and axially offset and are driven in unison. A yarn thread runs past each of these rollers and is arranged to be pressed against the respective roller 18, 36, 38, 40, 42 or 44 by means of an associated idler roller. This is not shown in FIG. 1 for clarity.

The random generator 32 is so designed and programmed that it will control the following functions within given limits and in accordance with random distribution:

(a) the selection of the idler roller 26 . . . which is pressed against the associated roller 18 or 36, 38, 40, 42 or 44, the associated pressing on roller 24, by which the respective yarn thread 12 . . . was pressed against the first roller 16, is lifted.

(b) the time difference between the idler of the various idler rollers 26 . . . against the associated roller 18 and 36, 38, 40, 42 or 44, respectively, of the stepped roller means, and (c) the time interval during which the various pressing on rollers 26 . . . are pressed against the associated roller 18 or 36, 38, 40, 42 or 44, respectively, of the stepped roller means.

Figure 2:
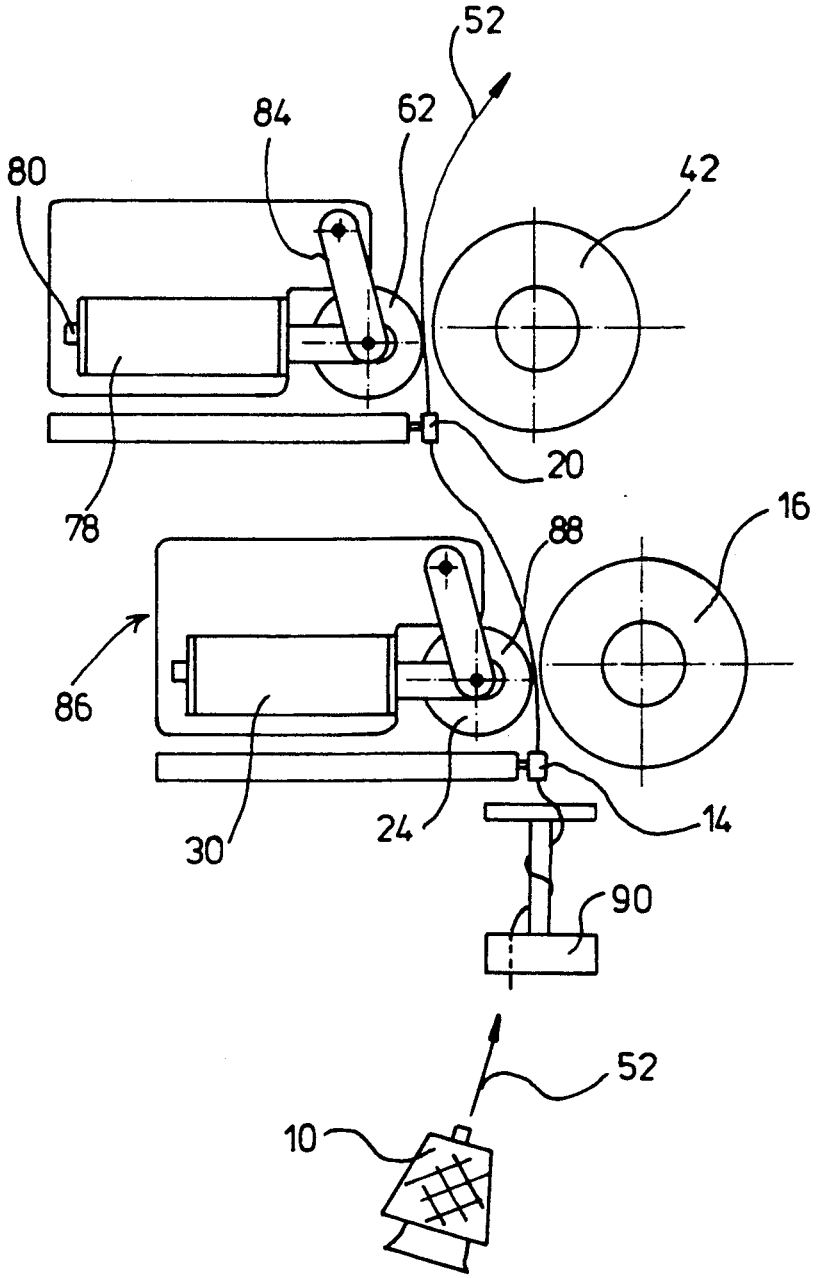
FIG. 2 is a plan view of a feed device in a device as shown in FIG. 1.
Figure 3:
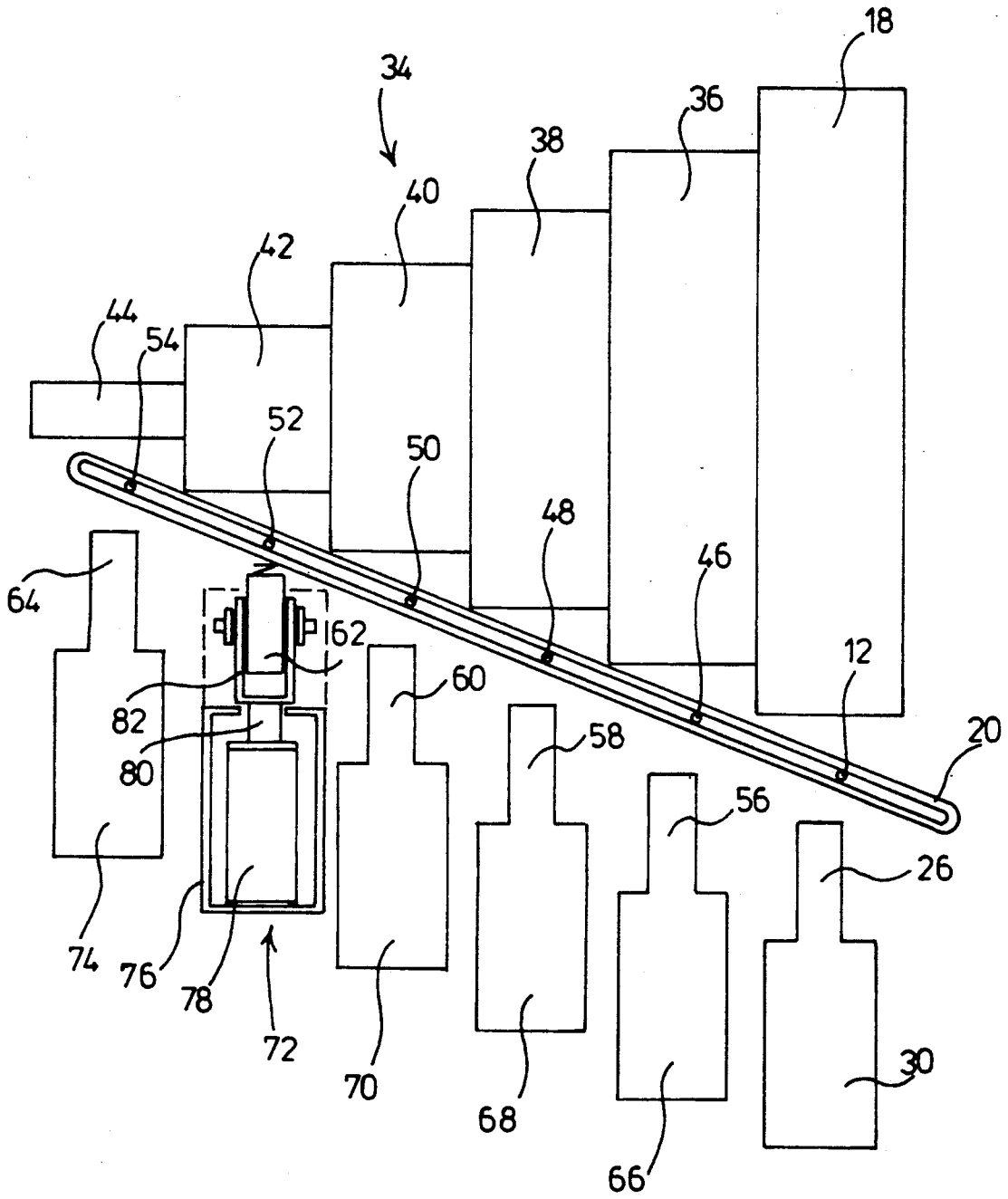
FIG. 3 is a side elevational view of the feed device.

FIGS. 2 and 3 illustrate the feed device in greater detail but still schematically. Corresponding elements bear the same reference numerals as in FIG. 1.

In the plan view of FIG. 3, the rollers 18 and 36, 38, 40, 42 and 44 of the stepped roller means 34 are illustrated. Yarn threads 12, 46, 48, 50, 52 and 54 are guided past the rollers 18, 36, 38, 40, 42 and 44, respectively. The yarn threads 12, 46, 48, 50, 52 and 54 are arranged to be pressed against the associated rollers 18, 36, 38, 40, 42 and 44, respectively, by idler rollers 26, 56, 58, 60, 62 and 64, respectively. This is caused by solenoids 30, 66, 68, 70, 72 and 74, respectively, the control of the idler roller 62 by the solenoid 72 being illustrated in detail in FIGS. 2 and 3.

The solenoid 72 comprises a housing 76. A magnet coil 78 is mounted in the housing 76. The magnet coil acts on a magnetic armature 80, which makes a stroke, when the magnet coil is energized, and is moved out of the magnet coil towards the roller 42. The idler roller 62 is mounted in a bifurcated end of the magnetic armature 80. In addition the idler roller 62 is held in a roller holder 84, which is pivotably mounted in the housing 76. The roller holder 84 takes up the weight of the pressing-on roller 62 and the transverse forces acting on the idler roller whereby the magnetic armature is relieved therefrom. the stepped roller means 34 in the preferred embodiment:

The stepped roller means 34 is driven at a rotary speed of 1,400 revolutions per minute. With a feed speed of 200 m/min this would result in a roller diameter of D=45.5 mm for the smallest roller 44. For an "over-feed", thus a feed increased relative to the "normal" rate of feed provided by the roller 16, the following roller diameters will result:

roller 42 with +50% over-feed 68.35 mm
roller 40 with +100% over-feed 91.00 mm
roller 38 with +150% over-feed 113.75 mm
roller 36 with +200% over-feed 136.50 mm
roller 18 with +250% over-feed 159.25 mm Then, for example, yarn may be provided with fancy twists as follows:

A basic yarn thread 54 is delivered through the stepped roller 34 (roller 44) continuously at the normal feed speed of, for example, 200 m/min. One yarn thread each 52, 50, 48, 46 and 12 is arranged to be delivered at a feed speed increased by 1:1.5; 1:2.0; 1:2.5; 1.3.0 and 1:3.5, when the respective solenoids are energized. The change between the solenoids and the durations of and time intervals between such energizations are controlled by the random generator. The values of the duration of the energization and the time intervals between the energizations follow a random distribution but lie within given and selectable lower and upper limits. The construction and the programming of a random-noise generator which performs the functions stated above is well known to persons skilled in the field and, therefore, is not described in detail here.

The solenoid 86 is of similar design. The solenoid 86 actuates the associated idler roller 88, by means of which the yarn thread 52 can be pressed against the first roller 16.

In similar manner, also the solenoids 30 and 66, 68, 70 and 72 and the associated rollers cooperating with the first roller 16 and the solenoids controlling these rollers, are designed.

The device described is adapted to draw six different and, if desired, also differently colored yarn threads from the supply spools and to feed them either with equal speeds through the first roller 16 to the fancy twist device 22 or at different speeds, depending on which of the rollers 26, 56, 58, 60, 62 or 64 presses the yarn thread against the associated roller 18, 36, 38, 40, 42 or 44, respectively. Correspondingly, different fancy twists on the yarn thus formed are caused.

Figure 4:
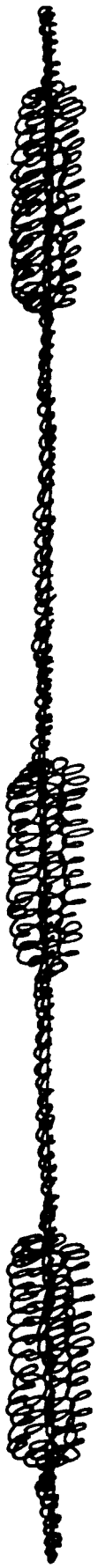
FIG. 4 is an example of a fancy twist yarn obtained with a device of the present type.

FIG. 4 illustrates an example of a yarn provided with such fancy twists.

At the upper end of FIG. 2, the yarn thread 52 is guided to an air nozzle or some other fancy twist device, which is known per se and, therefore, is not illustrated here in detail.

In a preferred embodiment the first roller 16, the feed roller, has a diameter of 130 millimeters (mm). This results in a circumference of U=408.2 meters (m)/min. In order to achieve a feed speed of 200 m/min a rotary speed of 470 revolutions per minute is required.

The following dimensions are selected for the rollers of The rollers of the stepped roller means 34 are exchangeable. Therefore operation with other combinations of roller diameters is possible. For example one yarn thread can be delivered through a first roller 16 at a feed speed of 200 m/min, while five additional yarn threads are arranged to be delivered through rollers of the stepped roller means at speeds increased at a ratio of 1:1.5; or 1:2.0 or 1:2.5 etc.

Therefore the arrangement described permits a multitude of possible variations.

I claim:

1. An arrangement for the generation of fancy twists arranged and/or formed at random on a yarn, comprising a) a fancy twist device through which at least one yarn thread is led, and b) a feed device adapted to feed a yarn thread at different speeds through the fancy twist device, said feed device comprising:

a first roller, which rotates at a first constant speed a second roller, which rotates at a second constant speed which differs from that of the first roller, and a plurality of idler rollers which are electromagnetically controlled and which are arranged to press the yarn thread alternatingly against the first and the second rollers at a predetermined overall feed speed, and a plurality of solenoids, each said solenoid being connected to a respective idler roller, and, c) a control device for generating control commands for controlling said plurality of idler rollers of the feed device at a predetermined response time in an irregular sequence in order to thereby change the feed speed of said feed device, characterized in that d) the idler rollers of said plurality of idler rollers are each movable by respective separate solenoids to selectively press the yarn thread against an associated one of the first and second rollers and, e) the solenoids being responsive to said control commands generated by said control device to operate said plurality of idler rollers in push-pull mode, whereby as the overall response time of the feed device reduces the overall feed speed of the feed device increases.

2. A device as claimed in claim 1, wherein the control device is an electronic random generator.

3. A device as claimed in claim 1, wherein each idler roller is mounted directly on the armature of the respective solenoid.

4. An arrangement for the generation of fancy twists arranged and/or formed at random on a yarn, comprising:

(a) a fancy twist device through which at least one yarn thread is fed;

(b) a feed device adapted to feed a yarn thread at different speeds through the fancy twist device, said feed device comprising:

a first roller, which rotates at a first speed;

a stepped roller comprising a plurality of second rollers, each said second roller having a different diameter and each said second roller rotating at a second speed which differs from that of said first roller;

a plurality of idler rollers, each said idler roller being electromagnetically controlled and being arranged to press the yarn thread aginst the first roller or a second roller, each said second roller being associated with a respective idler roller;

a plurality of solenoids, each said solenoid having an armature, each said idler roller is mounted directly on the armature of a respective solenoid;

(c) a control device arranged to control the feed device in an irregular sequence; characterized in that (d) each said second roller of the stepped roller is associated with an idler roller which is movable in engagement position by a separate solenoid;

(e) a plurality of yarn threads are guided over one second roller each of said stepped roller;

(f) each idler roller is movable by a separate solenoid to press the yarn thread against the first roller and to press the yarn thread against the second roller; and (g) the solenoids are controllable by the control device in push-pull mode.

5. A device as claimed in claim 4, wherein the control device is an electronic random generator and wherein the random generator is programmed to control the following functions according to random distributions within given limits:

a) the selection of the idler roller to be pressed against the associated roller of the stepped roller means while simultaneously lifting the idler roller by which the respective yarn thread was pressed against the first roller, b) the time interval between the pressing of the different idler rollers against the associated roller of the stepped roller means and c) the time intervals, during which the different idler rollers were pressed against the associated roller of the stepped roller means.

* * * * *